US006900585B2

(12) United States Patent
Kim et al.

(10) Patent No.: US 6,900,585 B2
(45) Date of Patent: May 31, 2005

(54) SPACER FOR AN ELECTRODE OF A COLOR FLAT PANEL DISPLAY

(75) Inventors: Byoung Nam Kim, Daejeon-si (KR); Tae Yong Kim, Gyeongsangbook-do (KR); Jong Ho Lim, Daegu-si (KR); Nam Je Koh, Gyeongsangbook-do (KR)

(73) Assignee: LG. Philips Displays Korea Co., Ltd., Gyeongsangbuk-do (KR)

( * ) Notice: Subject to any disclaimer, the term of this patent is extended or adjusted under 35 U.S.C. 154(b) by 36 days.

(21) Appl. No.: 10/376,334

(22) Filed: Mar. 3, 2003

(65) Prior Publication Data

US 2003/0164676 A1 Sep. 4, 2003

(30) Foreign Application Priority Data

Mar. 4, 2002 (KR) ..... 2002-11368
Jan. 13, 2003 (KR) ..... 2003-02029

(51) Int. Cl.[7] ..... H01J 1/62; H01J 63/04; H01J 29/70; H01J 01/02

(52) U.S. Cl. ..... 313/495; 313/496; 313/497; 313/422; 313/310

(58) Field of Search ..... 313/495–497, 313/422, 292

(56) References Cited

U.S. PATENT DOCUMENTS 3,935,500 A * 1/1976 Oess et al. ..... 313/495
3,936,697 A * 2/1976 Scott ..... 315/12.1
4,804,887 A * 2/1989 Miyama et al. ..... 313/495
5,565,742 A * 10/1996 Shichao et al. ..... 315/366
5,859,508 A * 1/1999 Ge et al. ..... 315/366
6,844,666 B2 * 1/2005 Chun et al. ..... 313/422

FOREIGN PATENT DOCUMENTS

| | | |
|---|---|---|
| JP | 53-38260 | 4/1978 |
| JP | 53-74357 | 7/1978 |
| JP | 54-120582 A | 9/1979 |
| JP | 2-250247 A | 10/1990 |
| JP | 3-184247 A | 8/1991 |
| JP | 3-205751 A | 9/1991 |

* cited by examiner

*Primary Examiner*—Joseph Williams
*Assistant Examiner*—Matt Hodges
(74) *Attorney, Agent, or Firm*—Birch, Stewart, Kolasch & Birch, LLP

(57) ABSTRACT

Disclosed is a color flat panel display comprising a rear glass, a rear electrode, a filament cathode for emitting electrons, a control electrode, a signal modulation electrode, a focus electrode, a horizontal deflection electrode, a vertical deflection electrode, a front glass on which a phosphor screen is formed, and a spacer for maintaining an interval between the electrodes, wherein the spacer is plate-shaped and has a space part through which electron beams pass at an inside of thereof.

15 Claims, 7 Drawing Sheets

SPACER FOR AN ELECTRODE OF A COLOR FLAT PANEL DISPLAY

BACKGROUND OF THE INVENTION

1. Field of the Invention

The present invention relates to a color flat panel display, and more particularly, to a spacer forming the spacing between electrodes of a color flat panel display.

2. Description of the Related Art

Recently, an electroluminescent display (ELD), a plasma display panel (PDP), a liquid crystal display (LCD) and the like have been developed as a color flat panel display. However, in comparison with a cathode ray tube (CRT) that uses an electron beam, the conventional color flat panel display bas not reached a satisfactory level in view of performances such as a luminance, a contrast and a color reproduction To overcome the restrictions of the conventional color flat panel display (the ELD, the PDP and the LCD) and implement a high-quality image comparable to the CRT, there have been proposed an improved color flat panel display that is based on a screen scanning of an electron beam.

Meanwhile, Japan Laid-open Publications No 3-184247 and No. 3-205751 disclose an image display apparatus for displaying a high-quality image comparable to the CRT on a flat panel display that uses an electron beam, in which an image displayed on a screen is divided into unit cells constituting a matrix and then an electron beam is deflectively scanned to each unit cell, so that a phosphor screen is light-emitted to thereby display an entire color image.

FIG. 1 is a view of a conventional color flat panel display based on a screen scanning of an electron beam.

FIG. 1 is an exploded perspective view showing main elements of the conventional color flat panel display. Referring to FIG. 1, the conventional color flat panel display includes a rear glass 1, a rear electrode 2, a filament cathode 3, a control electrode 4, a signal modulation electrode 5, a focus electrode 6, a horizontal deflection electrode 7, a vertical deflection electrode 8, and a front glass 9, all of which are arranged one after another. In addition, the rear glass 1 and the front glass 9 are sealed to maintain a vacuum state.

In more detail, the rear electrode 2 is formed of a conductive material such as metal and graphite on a flat panel. The rear electrode 2 is arranged in parallel with the filament cathode 3 and a negative voltage is applied to the rear electrode 2 to thereby cause an electron emitted from the filament cathode 3 to be directed toward the screen.

Generally, the filament cathode 3 is formed coating an oxide cathode material on a surface of a tungsten wire. At this time, a plurality of filament cathodes are arranged to generate the electron beam constantly distributed in a horizontal direction.

As an electrode for drawing the electron beam 11, the control electrode 4 is spaced apart from the filament cathode 3 by a predetermined distance and disposed in a direction of the screen. Also, the control electrode 4 is faced with the rear electrode 2 and formed of a conductive plate in which passing holes are disposed at each predetermined distance in a horizontal direction and formed on a horizontal line facing each filament cathode 3 by a predetermined distance.

The signal modulation electrode 5 includes a row of conductive plates, each of which is arranged on a position facing each passing hole of the control electrode 4 and spaced apart from the control electrode 4 by a predetermined distance. At this time, each conductive plate is thin and long in a vertical direction. Each conductive plate of the signal modulation electrode 5 has passing holes formed in the same plane on a position facing each passing hole of the control electrode 4.

The focus electrode 6 is formed of a conductive plate having passing holes formed on each position facing each passing hole of the signal modulation electrode 5. The horizontal deflection electrode 7 includes two conductive plates meshed with each other on a sectional portion and spaced apart by a predetermined distance on the same plane.

Further, the vertical deflection electrode 8 also includes two conductive plates meshed with each other on a sectional portion and spaced apart by a predetermined distance on the same plane.

Generally, all of the above-described electrodes are manufactured using an Invar (Fe-Ni alloy) in order to prevent an image quality from being degraded due to a thermal deformation. Each of the control electrode 4, the signal modulation electrode 5, the focus electrode 6, the horizontal deflection electrode 7 and the vertical deflection electrode 8 is joined with an insulating adhesive.

FIG. 2 is a view explaining a phosphor screen of the conventional color flat panel display.

Referring to FIG. 2, a phosphor screen 15 is formed on the front glass 9 and R, G and B phosphors 12 are coated on an inner side of the front glass 9. Black matrixes (BM) 14 are formed between the phosphors 12.

In addition, a metal back 13 is formed on the phosphors 12 to thereby reflect and project a light generated by the phosphors 12 on the front glass 9.

On the basis of the above structure, an operation of the conventional color flat panel display will be described below with reference to FIGS. 1 and 2.

If a voltage is applied to the filament cathode 3, electrons are emitted. At this time, the filament cathode 3 is heated by passing a current therethrough in order to easily obtain the electron emission.

The electrons emitted from the filament electrode 3 are divided into multiple parts by the passing holes of the control electrode 4 and its amount is controlled.

A passing amount of the electron beam 11 passed through the control electrode 4 is controlled corresponding to an image signal at the signal modulation electrode 5.

The electron beam 11 passed through the signal modulation electrode 5 is focused at the passing holes of the focus electrode 6 due to a static lens effect. The electron beam 11 is deflected by passing both the horizontal deflection electrode 7 and the vertical deflection electrode 8 and then it is scanned to the phosphor 12 of corresponding unit cell 10, thereby displaying a desired image.

At this time, a voltage applied to the electrode adjacent to the screen is maximally of 600 V and a voltage of the screen is approximately of 10,000–14,000 V.

In other words, since a high voltage of approximately 10,000 v is applied to the metal back 13, the electron beam 11 is accelerated to a high energy and collided against the metal back 13, thereby light-emitting the phosphor 12.

FIG. 3 is a view showing a structure of the vertical deflection electrode 8 in the conventional color flat panel display.

As shown in FIG. 3, the vertical deflection electrode 8 is made in a structure that two conductive plates 8*a* and 8*b* are meshed with each other on a sectional portion and spaced apart by a predetermined distance on the same plane.

In other words, it positive and negative voltages are applied to the conductive plates 8*a* and 8*b* respectively, an electric field is generated, and the electric field causes the electric beam to be deflected, thereby achieving a vertical deflection.

In addition, a horizontal deflection is achieved in the horizontal deflection electrode 7 by the same principle as the vertical deflection.

FIG. 4 is a view explaining an assembly process of the electrodes, in which a pre-sintering state and a post-sintering state are shown.

Explaining the assembly process of the electrodes with reference to FIG. 4, crystalline glass rods 22 of a relatively low melting point are inserted into both sides of amorphous glass rods 21 of a relatively high melting point between the electrodes, and then the sintering process is carried out. Consequently, the crystalline glass rods 22 are melted to wrap the amorphous glass rods 21, thereby acting as an adhesive.

In other words, the amorphous glass rods 21 are made from crystal that is the main raw material, and has a softening temperature of approximately 550° C. If the amorphous glass rods 21 are pressed at approximately 450° C. while being sintered, the crystalline glass rods 22 that have a melting point lower relative to the amorphous glass rods 21 are melted, so that both electrodes are bonded.

At this time, a gap between both electrodes is maintained as much as a diameter of the amorphous glass rod 21, and thus the amorphous glass rods 21 serve as the spacer.

In the meanwhile, in order to improve the brightness uniformity of an image that is the most important factor in reproducing a moving picture, it is the most important to allow the gap between the electrodes to be maintained at a constant size.

In particular, in case the gap between the electrodes in a color flat panel display is changed, the image size of the electron beam is changed too, so that the brightness uniformity is not obtained and a whole image quality is deteriorated.

Accordingly, it is necessary to maintain the gap between the electrodes at a constant size. The amorphous glass rods 21 are made from crystal not having a variation in the shape or diameter at an approximately 450° C. Then, since the cost of the amorphous glass rods 21 corresponds to 70% of the overall cost of all the electrodes, the manufacturing costs of the color flat panel display increase.

In addition, it is requested to arrange the pair of crystalline glass rods 22 at both sides of the amorphous glass rods 21 during the bonding process of the respective electrodes. In order to bond all the electrodes, working time and the number of the bonding process increase, so that there occurs a problem in that the manufacturing costs increase.

SUMMARY OF THE INVENTION

Accordingly, it is an object to simplify the manufacturing process and save the manufacturing costs by using an integral type spacer instead of using the amorphous glass rods and the crystalline glass rods so as to maintain the gap between the electrodes at a constant size.

To achieve these objects and other advantages and in accordance with the purpose of the invention, as embodied and broadly described herein, there is provided a color flat panel display comprising a rear glass, a rear electrode, a filament cathode for emitting electrons, a control electrode, a signal modulation electrode, a focus electrode, a horizontal deflection electrode, a vertical deflection electrode, a front glass on which a phosphor screen is formed, and a spacer for maintaining an interval between the electrodes, wherein the spacer is plate-shaped and has a space part through which electron beams pass at an inside of thereof.

In an aspect of the invention, there is provided a color flat panel display comprising a rear glass, a rear electrode, a filament cathode for emitting electrons, a control electrode, a signal modulation electrode, a focus electrode, a horizontal deflection electrode, a vertical deflection electrode, a front glass on which a phosphor screen is formed, and a spacer for maintaining an interval between the electrodes, wherein the spacer is plate-shaped, has a space part through which electron beams pass at an inside thereof, and is made of ceramic-based insulator.

In another aspect of the invention, there is provided a color flat panel display comprising a rear glass, a rear electrode, a filament cathode for emitting electrons, a control electrode, a signal modulation electrode, a focus electrode, a horizontal deflection electrode, a vertical deflection electrode, a front glass on which a phosphor screen is formed, and a spacer for maintaining an interval between the electrodes, wherein the spacer is plate-shaped, has a space part through which electron beams pass at an inside thereof, and comprises a metal member and an insulator film coated on the metal member.

It is to be understood that both the foregoing general description and the following detailed description of the present invention are exemplary and explanatory and are intended to provide further explanation of the present invention as claimed.

BRIEF DESCRIPTION OF THE DRAWINGS

The accompanying drawings, which are included to provide a further understanding of the present invention and are incorporated in and constitute a part of this application, illustrate embodiment(s) of the present invention and together with the description serve to explain the principle of the present invention. In the drawings.

DETAILED DESCRIPTION OF THE PREFERRED EMBODIMENTS

Reference will now be made in detail to a preferred embodiment of the present invention with reference to the attached drawings.

Figure 1:
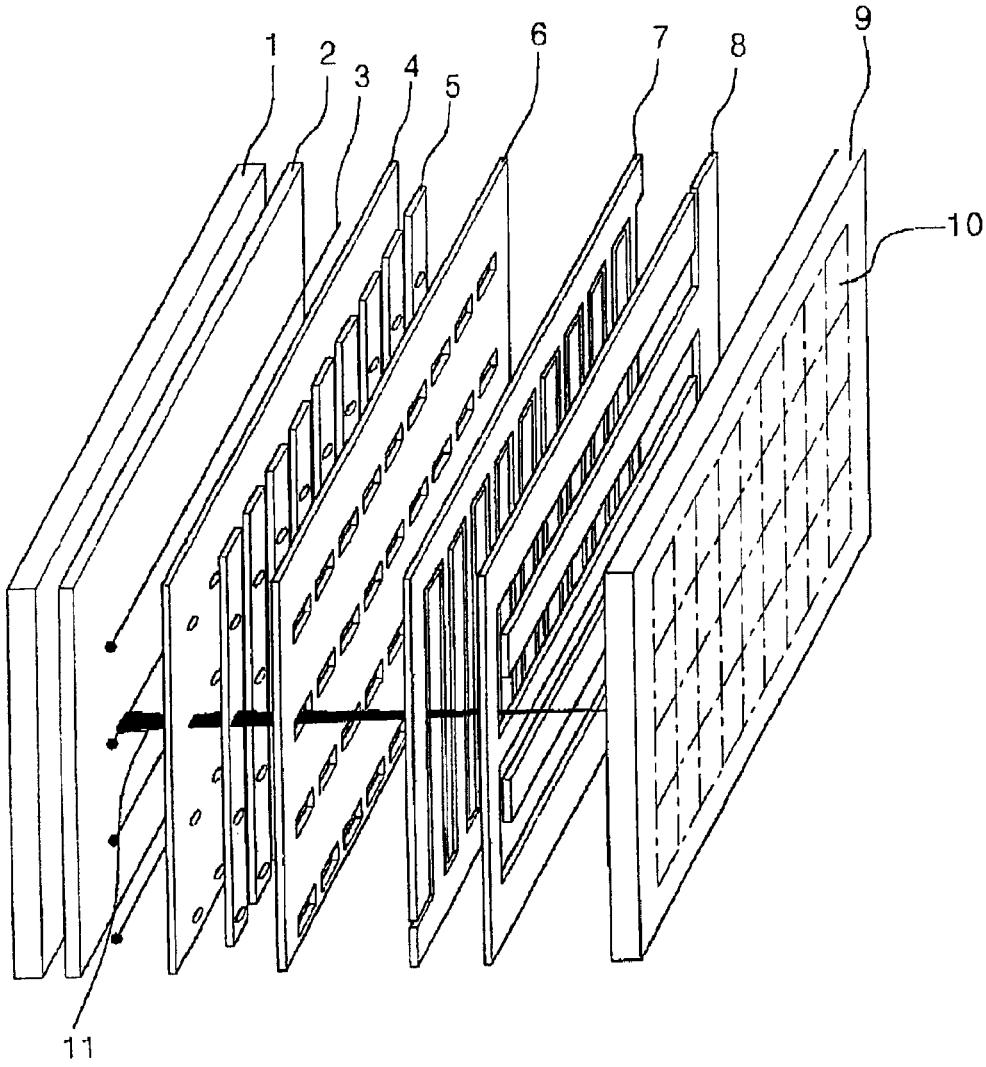
FIG.1 (Background Art)
FIG. 1 is a view of a conventional color flat panel display based on a screen scanning of an electron beam.
Figure 2:
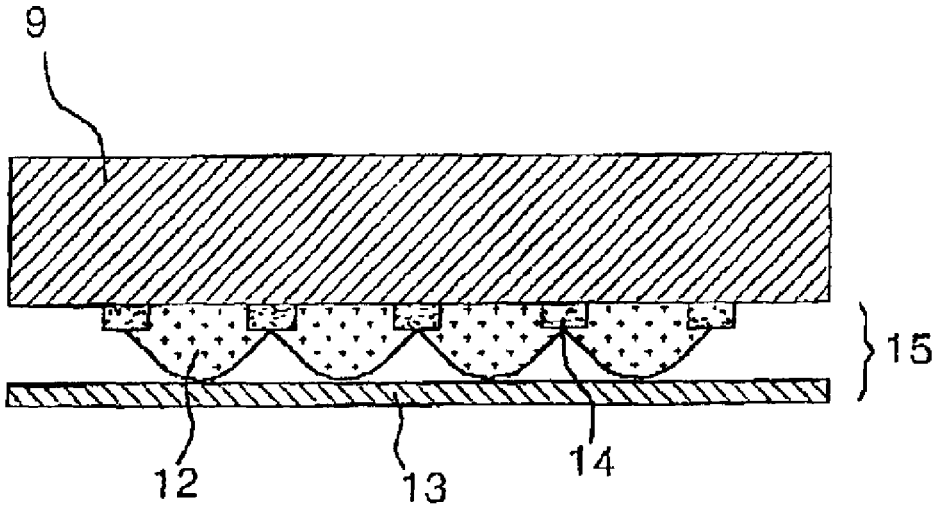
FIG. 2 (Background Art)
FIG. 2 is a view explaining the phosphor screen of the conventional color flat panel display.
Figure 3:
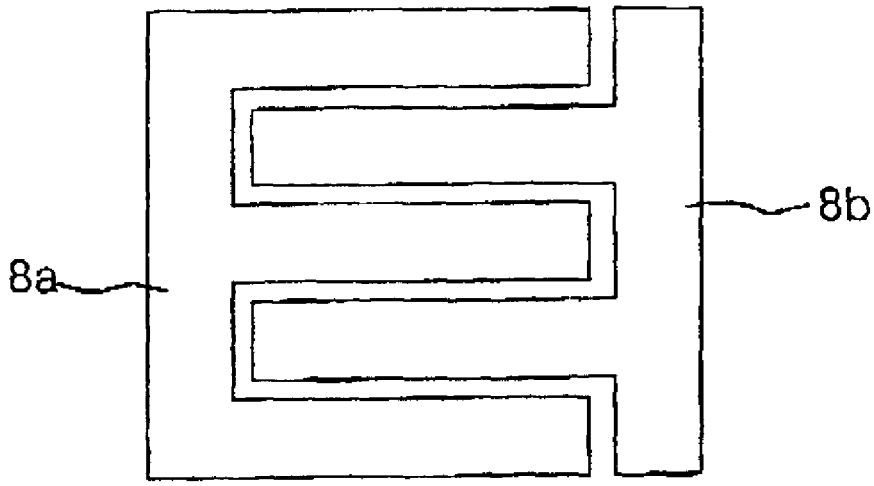
FIG. 3 (Background Art)
FIG. 3 is a view showing a structure of the vertical deflection electrode of the conventional color flat panel display.
Figure 4:
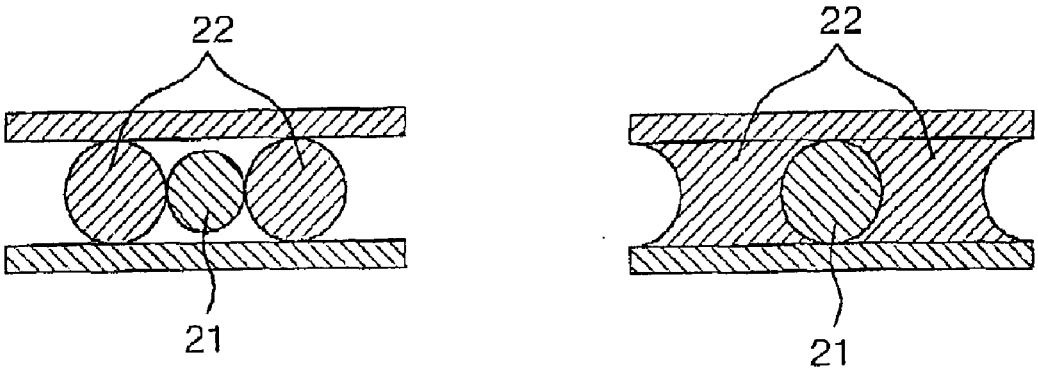
FIG.4 (Background Art)
FIG. 4 is a view explaining an assembly process of the electrodes, in which a pre-sintering state and a post-sintering state are shown.
Figure 5:
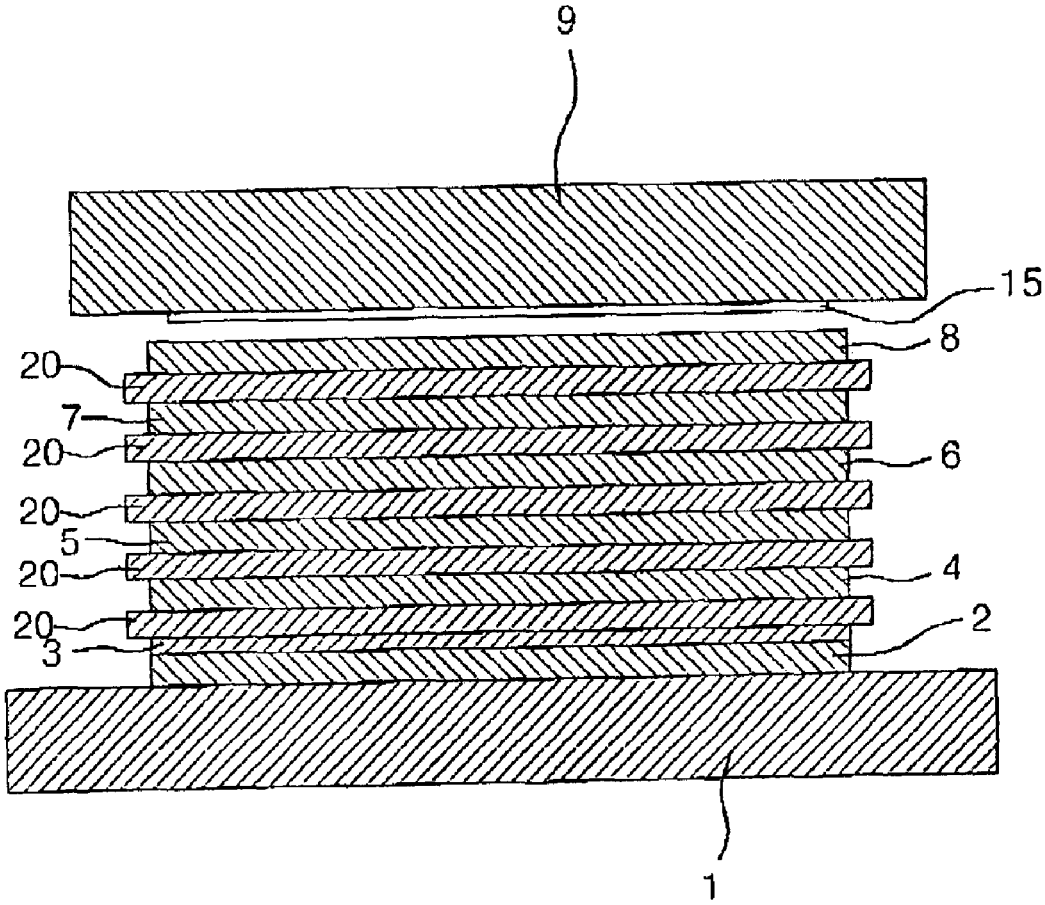
FIG. 5 is a view showing a structure of a color flat panel display in accordance with an embodiment of the present invention.

FIG. 5 is a view showing a structure of a color flat panel display in accordance with an embodiment of the present invention.

Referring to FIG. 5, a color flat panel display of the present invention comprises a rear glass 1, a rear electrode 2, a filament cathode 3 for emitting electrons, a control electrode 4, a signal modulation electrode 5, a focus electrode 6, a horizontal deflection electrode 7, a vertical deflection electrode 8, a front glass 9 on which a phosphor screen 15 is formed, and spacers 20 for maintaining an interval between the electrodes. Each of the spacers 20 is plate-shaped, and has a space through which electron beams pass at an inside thereof.

The spacers 20 allow the electrodes to be spaced by a certain interval from each other, and at the same time to be coupled with each other. The space of each of the spacers 20 is varied in its shape depending on the coupled electrode.

If a voltage is applied to the filament electrode 3, electrons are emitted. The filament electrode 3 is heated by flowing a current such that electrons are emitted with ease.

In other words, proper voltages are respectively applied to the rear electrode 2, the filament electrode 3 and the control electrode 4 such that electrons are emitted from the surface of the filament electrode 3.

The electrons emitted from the filament electrode 3 are divided into a plurality of electron beams by passing holes of the control electrode 4, and the amount of the divided electron beam is also controlled.

The amount of the electron beam 11 that passes through the control electrode 4 is controllable at the signal modulation electrode by image signals.

The electron beam 11 that has passed through the signal modulation electrode 5 is focused at passing holes of the focus electrode 6 by electrostatic lens effect, is deflected while passing through the horizontal deflection electrode 7 and the vertical deflection electrode 8, and is scanned on the phosphor 12 within a corresponding unit cell 10, so that a desired image is displayed.

Figure 6:
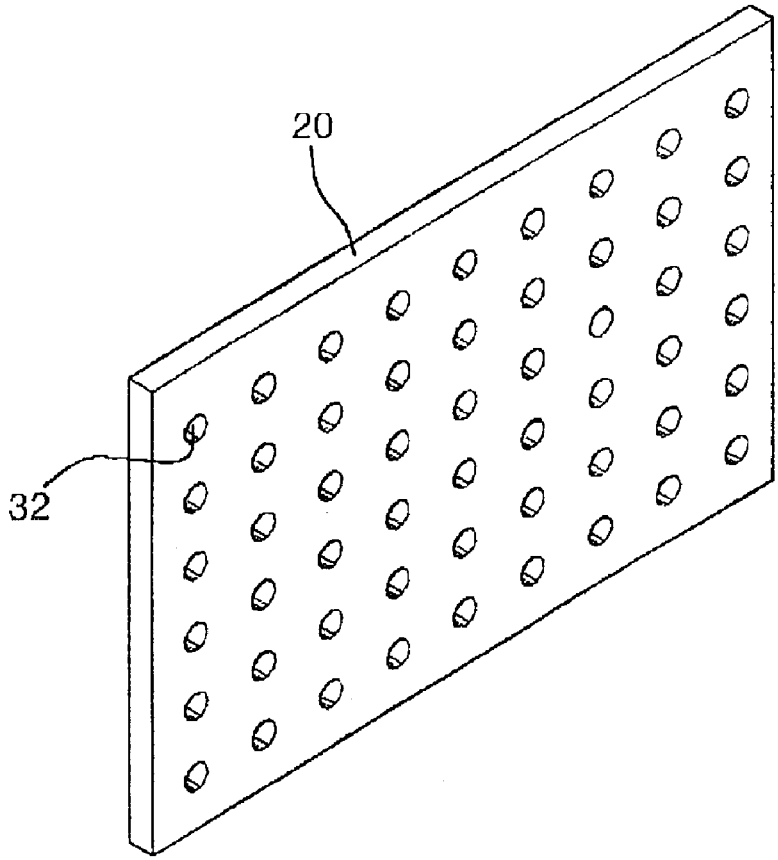
FIG. 6 is a view showing a structure of a spacer in a color flat panel display in accordance with the present invention.

FIG. 6 is a view showing a structure of a spacer in a color flat panel display in accordance with the present invention.

As shown in FIG. 6, the spacer 20 has a plate-shape, and includes a plurality of space portions or passage(s, through which electron beams pass at an inside thereof.

The shape of the plurality of space portions is changed depending on the kind of the electrode coupled thereto. The spacer shown in FIG. 6 is indicative of a spacer formed between the control electrode 4 and the signal modulation electrode 5.

It is desirable that the spacer 20 is made of insulating material. The insulating material is preferably a ceramic-based insulating material.

Also, the insulating material is preferably aluminum oxide, more preferably $Al_2O_3$.

Figure 7:
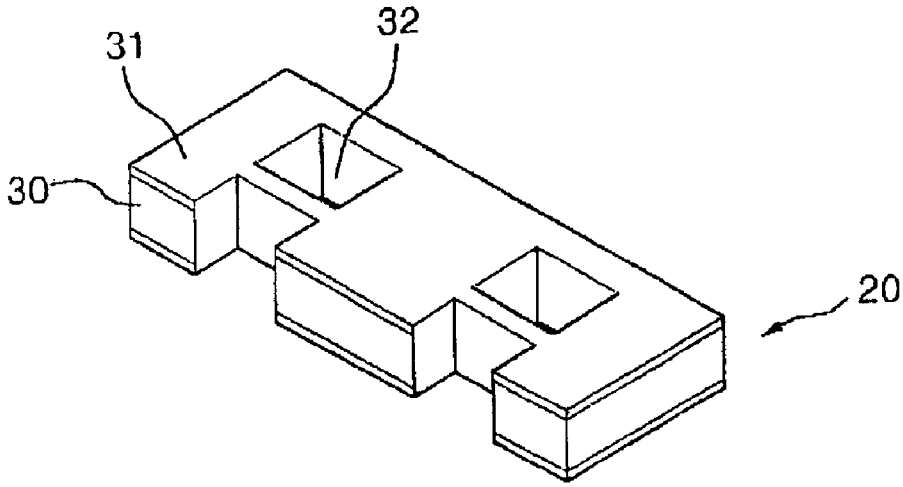
FIG. 7 is a view showing another structure of the spacer in a color panel display in accordance with the present invention.

FIG. 7 is a view showing another structure of the spacer in a color panel display in accordance with the present invention.

As shown in FIG. 7, the spacer 20 includes a metal member 30 for easy processing and an insulating film 31 coated on the metal member 30.

Considering the easy processing and the manufacturing costs, it is desirable that the metal member 30 is aluminum (Al).

Considering the insulation and processing properties, it is desirable that the insulating film 31 is a ceramic-based insulating material.

Also, the insulating film 31 is preferably aluminum oxide, more preferably $Al_2O_3$.

Figure 8:
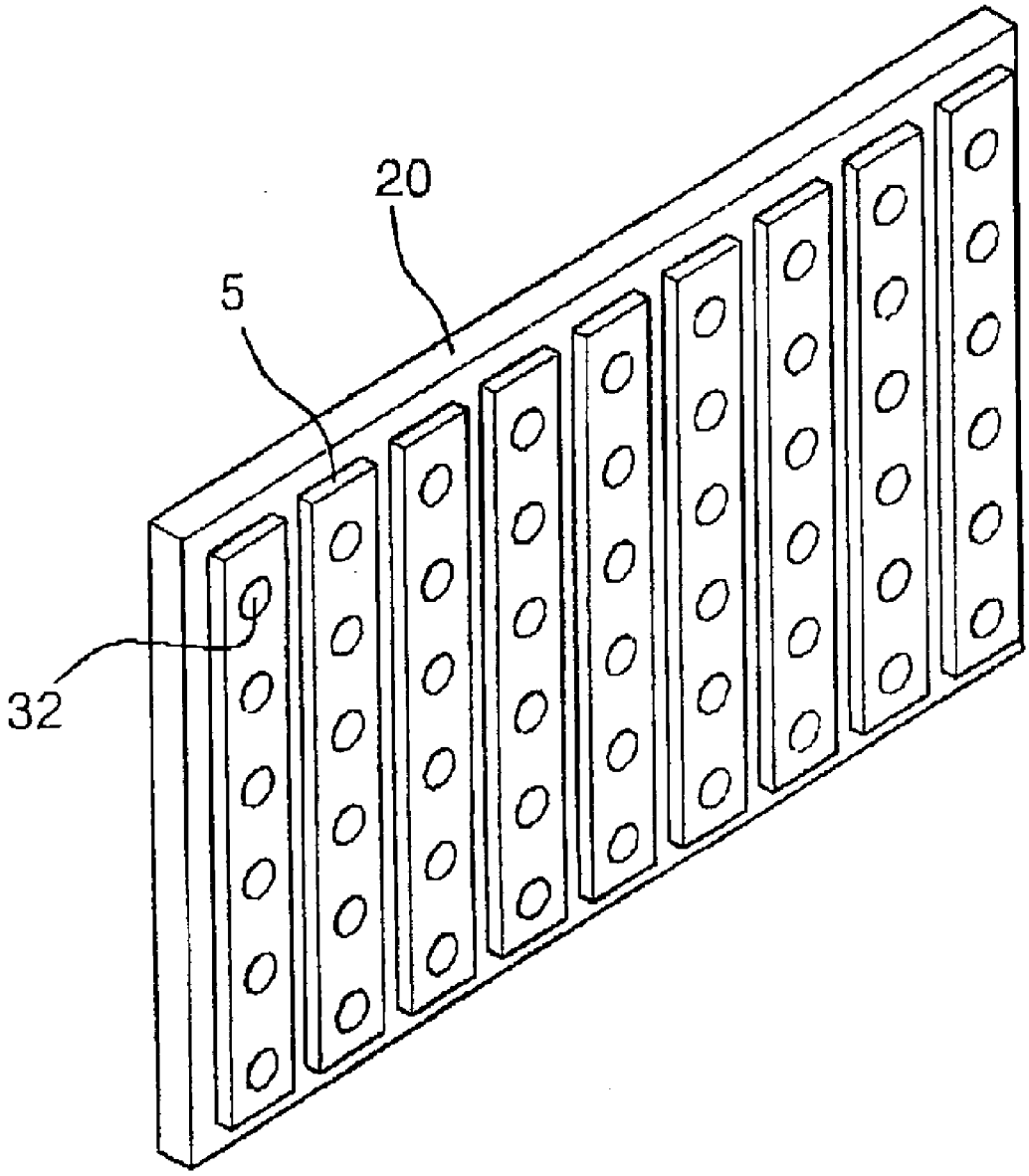
FIG. 8 is a view showing a coupling structure of the spacer and the signal modulation electrode in a color panel display in accordance with the present invention.

FIG. 8 is a view showing a coupling structure of the spacer and the signal modulation electrode in a color panel display in accordance with the present invention.

Referring to FIGS. 6 and 8, the space portions 32 of the spacer 20 shown in FIG. 6 are formed to be matched with the electron beam-passing holes respectively formed in the control electrode 4 and the signal modulation electrode 5, and the signal modulation electrode 5 is coupled to one surface of the spacer 20.

Although not shown in the drawings, the control electrode 4 is coupled to the other surface of the spacer opposite to the one surface of the spacer 20 to which the signal modulation electrode 5 is coupled.

As aforementioned, the shape of the spacer portions 32 may be changed depending on the shape of the electrodes coupled to both surfaces of the spacer 20.

Figure 9:
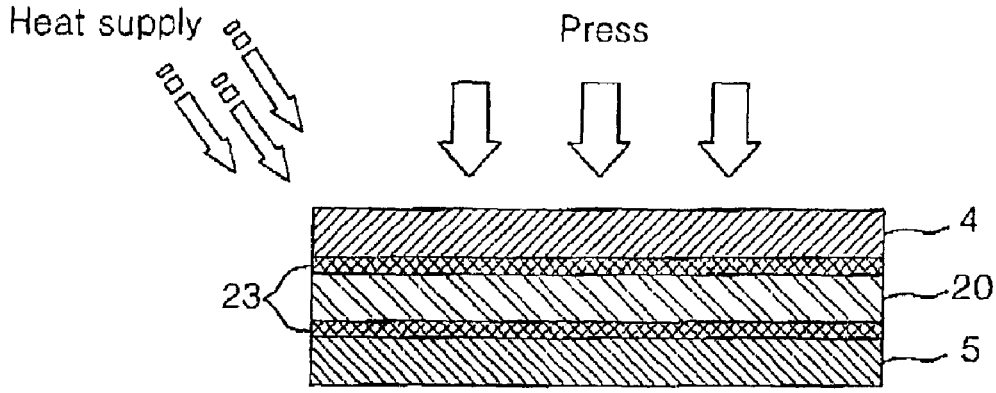
FIG. 9 is a view showing a coupling process of the electrode and the spacer in a color panel display in accordance with the present invention.

FIG. 9 is a view showing a coupling process of the electrode and the spacer in a color panel display in accordance with the present invention. The coupling process of the control electrode 4 and the signal modulation electrode 5 is shown in greater detail in FIG. 9.

First, frit glass layers 23 are coated on both surfaces of the spacer 20, and then the control electrode 4 and the signal modulation electrode 5 are respectively positioned on the frit glass layers 23.

After that, the control electrode 4 and the signal modulation electrode are sintered at a temperature range of 450–480° C. for 23–35 minutes with being pressed, so that the frit glass layers 23 are melted and coupled to.

Accordingly, a gap corresponding to the thickness of the spacer 20 is formed between the control electrode 4 and the signal modulation electrode 5.

Figure 10:
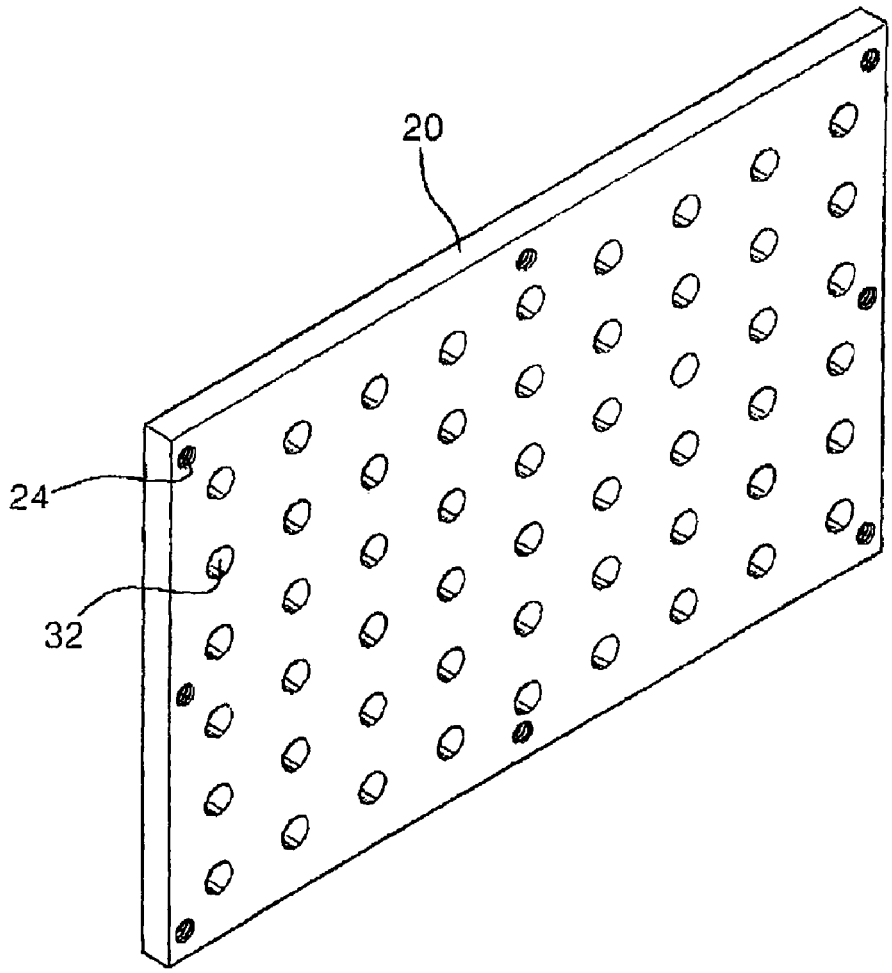
FIG. 10 is a view showing a structure of a spacer in accordance with another embodiment of the present invention.
Figure 11:
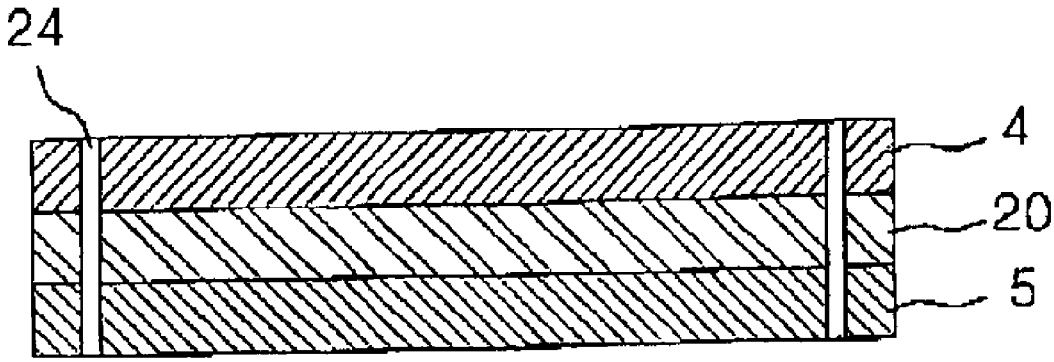
FIG. 11 is a view showing another coupling process of the electrodes and the spacer in a color panel display in accordance with the present invention.

FIG. 10 is a view showing a structure of a spacer in accordance with another embodiment of the present invention, and FIG. 11 is a view showing another coupling process of the electrodes and the spacer in a color panel display in accordance with the present invention.

The spacer 20 shown in FIG. 10 has a coupling hole 24, and the control electrode 4 and the signal modulation electrode 5 also have insertion holes. Accordingly, the electrodes and the spacer 20 are aligned with each other such that the coupling hole is matched with the insertion holes, and then they are unified by a bonding process.

The material used in the bonding process for unifying the spacer 20 and the electrodes 4, 5 is preferably an insulating material.

As described previously, the color flat panel display of the present invention provides advantages to simplify the manufacturing process and save the manufacturing costs by using an integral type spacer instead of using the amorphous glass rods and the crystalline glass rods so as to maintain the gap between the electrodes at a constant size.

The forgoing embodiment is merely exemplary and is not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A color flat panel display comprising:

a rear glass, a rear electrode, a filament cathode for emitting electrons, a control electrode, a signal modulation electrode, a focus electrode, a horizontal deflection electrode, a vertical deflection electrode, a front glass on which a phosphor screen is formed, and at least one spacer for maintaining an interval between at least two of said electrodes, wherein the at least one spacer is plate-shaped and includes at least one passage through which electron beams pass at an inside thereof;

a central metal member of aluminum (Al); and an insulating film of $Al_2O_3$ coated on the central metal member.

2. The color flat panel display according to claim 1, wherein said at least one spacer is respectively bonded to said at least two electrodes by a pair of frit glass layers.

3. The color flat panel display according to claim 1, wherein insertion holes are formed in said at least two electrodes and the at least one spacer further includes coupling holes corresponding to a location and a number of insertion holes formed in the at least two electrodes.

4. A color flat panel display comprising:

a rear glass, a rear electrode, a filament cathode for emitting electrons, a control electrode joined by a first spacer with said rear electrode and said filament cathode, a signal modulation electrode, a focus electrode joined by a second spacer with said signal modulation electrode, a horizontal deflection electrode, a vertical deflection electrode joined by a third spacer with said horizontal deflection electrode, a front glass on which a phosphor screen is formed, and wherein said first, second and third spacers maintain a predetermined interval between the respective electrodes, wherein the spacers are plate-shaped, and include at least one passage through which electron beams pass at an inside thereof, said spacers being made of a ceramic-based insulator with a central metal member of aluminum (Al).

5. The color flat panel display according to claim 4, wherein the insulator film is made of aluminum oxide.

6. The color flat panel display according to claim 4, wherein at least one of said spacers includes coupling holes corresponding to and aligned with insertion holes formed in each of the respective electrodes.

7. The color flat panel display according to claim 5, wherein the first, second and third spacers are joined to the respective electrodes by a pair of frit glass layers.

8. The color flat panel display according to claim 5, wherein said control electrode and said signal modulation electrode are bonded to a fourth spacer by an insulating material being provided within insertion holes formed in the control and signal modulation electrodes and aligned with respective coupling holes formed in the fourth spacer.

9. The color flat panel display according to claim 5, wherein at least one of said first, second and third spacers is bonded to respective electrodes with an insulating material provided in insertion holes being formed in the respective electrodes.

10. A color flat panel display comprising:

a rear glass, a rear electrode, a filament cathode for emitting electrons, a control electrode joined to said rear electrode and said filament cathode by a first spacer, a signal modulation electrode joined to said control electrode by a second spacer, a focus electrode joined to said signal modulation electrode by a third spacer, a horizontal deflection electrode joined to said focus electrode by a fourth spacer, a vertical deflection electrode joined to said horizontal deflection electrode by a fifth spacer, a front glass on which a phosphor screen is formed, and wherein said spacers are plate-shaped and maintain predetermined intervals between the respective electrodes and said spacers each include at least one passage through which electron beams pass at an inside thereof, and frit glass layers coated and sintered on both surfaces of at least one of the first, second, third, fourth and fifth spacers, the frit glass layers being joined with the respective electrodes.

11. The color flat panel display according to claim 10, wherein at least one of the spacers comprises a metal member of aluminum (Al) and an insulating film of $Al_2O_3$ coated on the metal member.

12. A method of forming the color flat panel display according to claim 10, said method comprising the steps of:

coating said fit glass layers on opposing surfaces of said at least one spacer;

positioning the respective electrodes on the coated, opposing surfaces; and sintering the electrodes at a predetermined temperature range for a predetermined period.

13. The method according to claim 12, wherein the temperature range is 450–480° C.

14. The method according to claim 12, predetermined period is 23–35 minutes.

15. The method according to claim 13, wherein the predetermined period is 23–35 minutes.

* * * * *